United States Patent [19]

Sälzer

[11] Patent Number: 4,806,910

[45] Date of Patent: Feb. 21, 1989

[54] ARRANGEMENT FOR REMOTE MONITORING OF THE POSITION AND/OR MOVEMENT OF A CLOSURE MECHANISM

[76] Inventor: Heinrich Sälzer, Industriestr. 4, D-3550 Marburg-Wehrda, Fed. Rep. of Germany

[21] Appl. No.: 96,714

[22] Filed: Sep. 14, 1987

[30] Foreign Application Priority Data

Sep. 24, 1986 [DE] Fed. Rep. of Germany ..... 3632367

[51] Int. Cl.[4] ..... G08B 13/08

[52] U.S. Cl. ..... 340/547; 340/542

[58] Field of Search ..... 340/547, 545, 542

[56] References Cited

U.S. PATENT DOCUMENTS

| | | | |
|---|---|---|---|
| 2,912,540 | 11/1959 | Sawicki | 340/547 |
| 3,161,742 | 12/1964 | Bagno | 340/547 |
| 3,803,575 | 4/1974 | Gotanda | 340/545 |
| 4,661,805 | 4/1987 | Sälzer | 340/547 |

FOREIGN PATENT DOCUMENTS 3409649 11/1985 Fed. Rep. of Germany .

*Primary Examiner*—Glen R. Swann, III

*Attorney, Agent, or Firm*—Arthur B. Colvin

[57] ABSTRACT

The monitoring arrangement consists of permanent magnets (M1, M2, M3) of different strengths which are associated with a closure mechanism. Combined in a structural unit (1), these act as signal transmitters. The structural unit (1), is, for example, so positioned in door leaf that, in the closed position of the mechanism the permanent magnets (M1, M2, M3) lie opposite sensors (S1, S2, S3) which are associated with a surrounding frame. These sensors combined in a structural unit (2), act as signal pick-ups, at which different voltages, which are increased by amplifiers V1, V2, V3, are applied as a result of differing magnetic field strengths. The output voltages thereof are adjustable by respective potentiometers and can be regulated to the threshold voltages of comparators (K1 to K6).

9 Claims, 1 Drawing Sheet

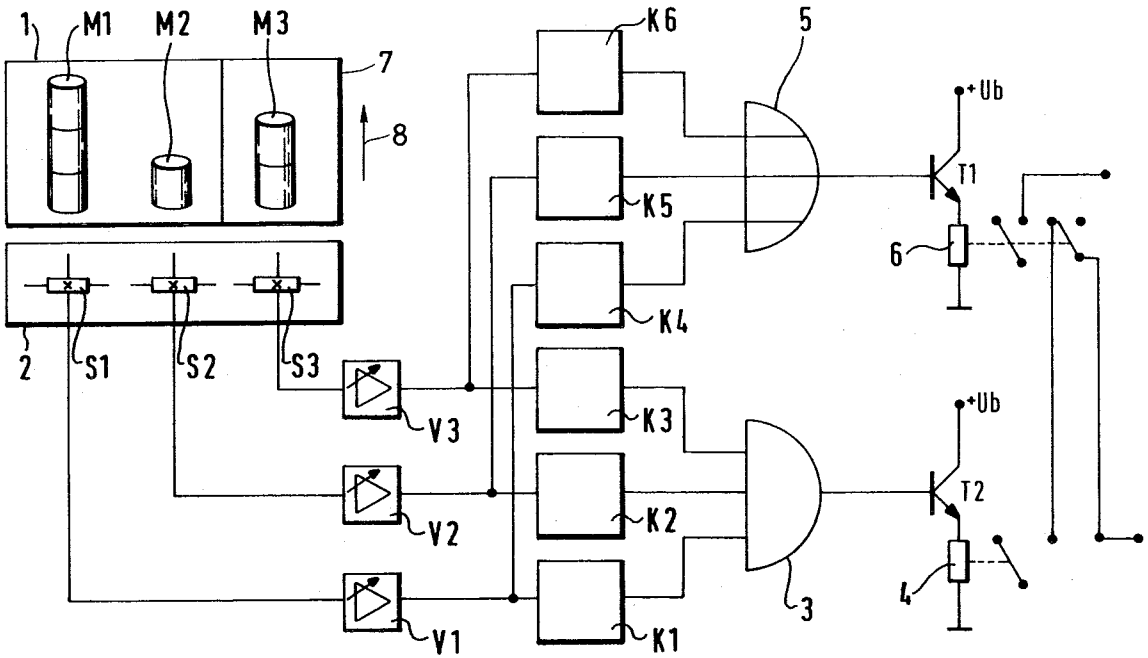
+Ub
T1
6
5
K6
K5
K4
+Ub
T2
4
3
K3
K2
K1
V3
V2
V1
7
8
M3
M2
M1
1
S3
S2
S1
2

ARRANGEMENT FOR REMOTE MONITORING OF THE POSITION AND/OR MOVEMENT OF A CLOSURE MECHANISM

BACKGROUND OF THE INVENTION

This invention relates to an arrangement for remote monitoring of the position and/or movement of a closure mechanism with respect to a frame surrounding same. The arrangement consists of several signal transmitters associated with the closure mechanism and signal pick-ups associated with the frame. In the closed position of the mechanism, signal transmission can be triggered because, on the one hand, the signal transmitters associated with the closure mechanism are positioned on or adjacent at least one surfce of the mechanism which lies in a plane extending perpendicularly to the plane of movement of the closure mechanism, and, on the other hand, the signal pick-ups associated with the frame are positioned in a corresponding manner on or adjacent at least one surface of the frame which lies opposite the relevant surface of the mechanism in the closed position.

THE PRIOR ART

In the case of such an arrangement known from DE-PS 34 09 649, a multiplicity of signal transmitters and pick-ups, appropriately arranged serve to indicate the movement and/or the position of a closure mechanism. In this respect, however, only a limited number of the signal transmitters and pick-ups are selected in a specific sequence for the signal transmission. Since neither the selected signal pick-ups and transmitters nor the sequence thereof in which these effect the signal transmission is perceptible from the outside, no special measure is needed to protect the signal transmitters or pick-ups against manipulations. As a result of the selected positioning of the signal transmitters and pick-ups and as a result of the selection thereof from a large number which come into register in a specific sequence during a swivel movement of the closure mechanism, which may, for example, be designed as a door leaf, the orderly movement cycle can be represented in a monitoring centre and the reaching of the closed position, for example as a prerequisite for an unlocking procedure of a following closure mechanism, which, together with the previous one forms a sluice system, can be registered.

In the case of the known arrangement theoretically an exceptionally large number of variations is afforded.

Preferably permanent magnets are used as signal transmitters, because these do not require leads laid into the movable closure mechanism. In this respect, however, the practical number of variations is considerably smaller than theoretically conceivable primarily because the permanent magnets used as signal transmitters require a minimum spacing in order not to influence one another mutually. In other words, if the permanent magnets are arranged too closely side-by-side, then the effects thereof impair one another. Furthermore, permanent magnets used as signal transmitters can lose field intensity. In this respect, if they are used, for example, in a door leaf consisting of metal, a short-circuit can arise in the magnetic circuit. In the known arrangement, therefore, narrow switching distances have to be adhered to, from which various disadvantages emerge. Firstly, the mounting is complicated, because the respective signal transmitters have to be placed comparatively close to the relevant signal pick-ups in order to guarantee switching reliability. Also the unvaried sensitivity of the signal evaluation may lead to mistaken indications when there is a weakening magnetic field.

The object of the invention is to provide an improved arrangement of the kind described at the beginning hereof, in such a way that a larger number of practically achievable variations in its structure and in its mode of operation are possible so that, in this way, unauthorized manipulation of the device is precluded to a considerably higher degree than in the case of the known arrangement the advantages of which are to be retained.

This object is achieved in accordance with the invention by an arrangement as set out in the first paragraph hereto characterized in that an arrangement for remote monitoring of the position and/or movement of a closure mechanism with respect to a frame which surround same in its closed position, said arrangement consisting of several signal transmitters associated with the closure mechanism and signal pick-ups associated with the frame, in which respect the signal transmitters associated with the closure mechanism are positioned on or adjacent a surface of the closure mechanism which lies in a plane perpendicular to a plane of movement of the closure mechanism and the signal pick-ups associated with the frame are positioned in a corresponding manner on or adjacent a surface of the frame which lies opposite the relevant surface of the closure mechanism in the closed position of same so that signal transmission may be triggered in the closed position of the closure mechanism, characterized in that the signal transmitters consists of mutually different permanent magnets having dissimilar field intensities and the signal pick-ups consist of sensors which are capable of being influenced by said magnets.

In the case of the signal transmitters consisting, in accordance with the invention, of mutually different permanent magnets having dissimilar field intensities, it is deliberately accepted that the permanent magnets, depending on their placing, influence one another. In the case of the signal transmitters in accordance with the invention, however, not only to the different field intensities, which the permanent magnets themselves create, have an effect, but also the field intensity variations by reason of the placing of the permanent magnets. As a whole, the overall scheme of field intensity distribution depends on the different sizes of the permanent magnets relative to each other and on the different spacings of the permanent magnets relative to each other. In this respect, it is only necessary to adjust the sensors, associated with the individual permanent magnets and acting as signals pick-ups, for example by means of a potentiometer, in such a way that they react by reason of the magnetic force acting on them whenever the signal transmitters are aligned with or superimposed upon the pick-ups. If, for example, a permanent magnet is removed from an arrangement which is coordinated as a whole in this way, the neighboring permanent magnets are immediately influenced in that the field intensity thereof is reduced or even completely cancelled. By way of an evaluation mechanism, for example, an alarm circuit can be activated as a result of this change. Similarly, an alarm circuit can be activated upon an attempt to change the polarity of a permanent magnet. Since the activation distance between the signal transmitters and pick-ups can also be adjusted in stepless manner, a change in any of the following parameters, indictive of an attempt at manipulation or tampering with the mechanism, can be detected:

Number of permanent magnets

Spacing of the permanent magnets from one another

Spacing of the permanent magnets with regard to the sensors.

Polarity of the permanent magnets

Each sensor acting as signal pick-up can, in accordance with a preferred embodiment of the invention, consists of a Hall generator or a field plate. Moreover, within the scope of the invention, a group of signal pick-ups may be made up of different types of sensors.

Where the signal pick-ups consist of Hall generators, in accordance with a further development of the invention, the voltage thereof can be applied to an amplifier and the output voltage of the amplifier may be adjustable by a potentiometer to a specific value which corresponds to the threshold voltage of a subsequently connected comparator.

Depending on the position of the closure mechanism, the voltage at the output of the comparator can be adjustable to one of two different values, whereby the closed position can be verified by means of a subsequently connected logic circuit.

In accordance with a further development of the invention, an indicating relay may be switched by one of the two different voltage values of the comparators of a first group by means of an AND-gate which is connected subsequent to this group.

Furthermore, in accordance with a development of the invention, a second group of comparators may be provided which react to an output voltage which is set both higher and lower relative to the first group of comparators, and an alarm relay is switchable by means of an OR-gate connected subsequent to these comparators.

It naturally lies within the scope of the invention to carry out in a different way the evaluation of the signals obtained by way of sensors. Thus, for example, the voltage channel at a sensor can be utilized for voltage frequency transformation and the frequency can be evaluated with the aid of a counting member.

Finally, a development of the invention provides for coupling a locking member of the closure mechanism with at least one permanent magnet which, in the locked state of the closure mechanism, lies opposite a sensor (in mirror-inverted manner). Thus, upon transfer of the locking member out of the locking position the permanent magnet mounted thereon is displaced out of the region lying opposite the sensor.

As a result of this development, the arrangement in accordance with the invention can be used to monitor not only whether the closure mechanism is disposed in the closed position but also whether it is in actual fact properly locked in this position.

It naturally also lies within the scope of the invention to accommodate a group of permanent magnets or all of the permanent magnets associated with any particular closure mechanism in a housing, to mount this so as to be displaceable and to couple same, for example, with a thrust rod which actuates locking elements, so that upon axial displacement of the latter all the permanent magnets are likewise shifted out of their position opposite the sensors.

BRIEF DESCRIPTION OF DRAWING

The invention will be described further, by way of example, with reference to the accompanying drawings wherein the single FIGURE depicts a wiring diagram in respect of an exemplified embodiment of an arrangement in accordance with the invention.

DETAILED DESCRIPTION OF DRAWING

In this arrangement, three permanent magnets M1, M2 and M3, combined in a structural unit 1, are associated as signal transmitters with a closure mechanism (not shown), which may consist, for example, of a swingable door leaf, the permanent magnet M1 consists of a three cylindrical magnetic pieces, the permanent magnet M2 consists of one such piece, and the permanent magnet M3 consists of two such pieces. Thus three mutually different signal transmitters are provided.

The structural unit 1 is set into the door leaf such that, in the closed position thereof, end surfaces of the permanent magnets M1, M2 and M3 lie opposite respective sensors S1, S2, S3, which are combined in a structural unit 2 set into a frame (likewise not shown) which surrounds the door leaf.

The respective permanent magnets M1, M2 and M3, which lie opposite the sensors S1, S2 and S3 in the closed position of the door leaf cause different voltages to be applied to the sensors S1, S2, and S3. In each case this voltage is increased by a respective amplifier V1, V2, V3 and the output voltage of each amplifier is adjustable by means of a potentiometer to the threshold voltage of a respective comparator K1, K2, K3.

At the output of each comparator K1, K2 and K3, the voltage may vary between 0 volt in the open position of the door leaf and a positive operating voltage in the closed position of the door leaf. Only when, as a result of closure of the door leaf, all the three comparators K1, K2 and K3 are connected to a positive operating voltage does a subsequently connected AND-gate 3 release current to a position line to bring about switching of an indicating relay 4.

A further three comparators K4, K5 and K6 react to output voltages of the respective amplifiers V1, V2, V3 which are set somewhat higher than the thresholds of comparators K1, K2, K3 or to negative output voltages. Whenever the output voltage of one of the amplifiers V1, V2 or V3 exceeds the switching threshold of its respective comparator K4, K5 or K6, or OR-gate 5 is enabled to switch in an alarm line via alarm relay 6 and current to the position line is interrupted. If an output voltage of one of the amplifiers V1, V2 or V3 assumes a negative value, for example due to rotation of the poles of the relevant permanent magnet M1, M2 or M3, the comparator K4, K5, or K6 likewise switches the alarm relay 6.

The device contemplates that a displaceable locking member 7 of the closure mechanism is coupled with at least one of the permanent magnets M3 which, in the locked position, lies opposite a sensor S3, said magnet being moved out of the region opposite the sensor upon the transfer of the locking member 7 out of the locking position in the direction of arrow 8.

The evaluation of the signals can be carried out by very different means and Hall generators or field plates are particularly suitable for this.

Having thus described the invention and illustrated its use, what is claimed as new and is desired to be secured by Letters Patent in the United States is:

1. An arrangement for remote monitoring of the position and/or movement of a closure mechanism with respect to a frame which surrounds same in its closed position, said arrangement consisting of several signal transmitters associated with the closure mechanism and signal pick-ups associated with the frame, in which respect the signal transmitters associated with the closure mechanism are positioned on or adjacent a surface of the closure mechanism which lies in a plane perpendicular to a plane of movement of the closure mechanism and the signal pick-ups associated with the frame are positioned in a corresponding manner on or adjacent a surface of the frame which lies opposite the relevant surface of the closure mechanism in the closed position of same so that signal transmission may be triggered in the closed position of the closure mechanism characterized in that the signal transmitters consist of mutually different permanent magnets having dissimilar field intensities and the signal pick-ups consist of sensors which are capable of being influenced by said magnets.

2. An arrangement as claimed in claim 1, characterized in that the sensors are selected from the class consisting of Hall generators, and field plates.

3. An arrangement as claimed in claim 2, characterized in that from a respective sensor consisting of a Hall generator a voltage can be applied to a respective amplifier.

4. An arrangement as claimed in claim 3, characterized in that the output voltage of each amplifier is adjustable by a potentiometer to a specific value which corresponds to the threshold voltage of a subsequently connected comparator.

5. An arrangement as claimed in claim 4, characterized in that the voltage at the output of each comparator is adjustable, depending on the position of the closure mechanism, to one of two different values, whereby the closed position can be verified by means of a subsequently connected logic circuit.

6. An arrangement as claimed in claim 5, characterized in that an indicating relay is switchable by one of the two different voltage values of the comparators of a first group by means of an AND-gate which is connected subsequent to this group.

7. An arrangement as claimed in claim 6, characterized in that a second group of comparators are provided which react to an output voltage which is set both higher and lower compared to the first group of comparators, and an alarm relay is switchable by means of an OR-gate connected subsequent to these comparators.

8. An arrangement as claimed in claim 1, characterized in that a displaceable locking member of the closure mechanism is coupled with at least one permanent magnet which, in the locked state of the closure mechanism, lies opposite a sensor, said magnet being moved out of the region opposite the sensor upon the transfer of the locking member out of the locking position.

9. An arrangement for remote monitoring of the position and/or movement of a closure mechanism with respect to a frame which surrounds same in its closed position, said arrangement consisting of several signal transmitters associated with the closure mechanism and signal pick-ups associated with the frame, in which respect the signal transmitters consist of mutually different permanent magnets having dissimilar field intensities and the signal pick-ups consist of sensors capable of being influenced by said magnets.

* * * * *